US007406838B2

(12) United States Patent
Wang

(10) Patent No.: US 7,406,838 B2
(45) Date of Patent: Aug. 5, 2008

(54) ICE-MAKING MACHINE

(76) Inventor: Ching-Hsiang Wang, P.O. Box 90, Tainan City 70499 (TW)

( * ) Notice: Subject to any disclaimer, the term of this patent is extended or adjusted under 35 U.S.C. 154(b) by 366 days.

(21) Appl. No.: 11/298,702

(22) Filed: Dec. 12, 2005

(65) Prior Publication Data

US 2007/0130982 A1 Jun. 14, 2007

(51) Int. Cl.
*F25C 1/12* (2006.01)

(52) U.S. Cl. ..... 62/344; 62/347; 62/352

(58) Field of Classification Search ..... 62/244; 165/42–43; 454/126, 156, 159
See application file for complete search history.

(56) References Cited

U.S. PATENT DOCUMENTS 3,418,823 A * 12/1968 Vivai ..... 62/138
3,791,166 A * 2/1974 Maleck ..... 62/138
4,207,750 A * 6/1980 Simkens ..... 62/138
4,685,304 A * 8/1987 Essig ..... 62/68
5,187,948 A * 2/1993 Frohbieter ..... 62/351
5,199,270 A * 4/1993 Simkens ..... 62/73
5,297,394 A * 3/1994 Frohbieter et al. ..... 62/135
5,425,243 A * 6/1995 Sanuki et al. ..... 62/138
5,524,451 A * 6/1996 Tippmann ..... 62/352
6,742,351 B2 * 6/2004 Kim et al. ..... 62/352
7,201,014 B2 * 4/2007 Hornung ..... 62/347

* cited by examiner

*Primary Examiner*—William E Tapolcai

(57) ABSTRACT

An ice-making machine includes a control faceplate and formed with a water tank and an accommodating hollow. The water tank has a water intake connected with the feed water pipe of the accommodating hollow. The accommodating hollow is bored with a draining channel communicating with the water tank and has an insert hole in a side and a trigger switch on an outer side. A water trough pivotally assembled in the accommodating hollow has a push plate at the front side and a pivot at the opposite sides to be fitted with the trigger switch. A freezing system installed in the machine body is composed of a compressor, a condenser, an electric magnetic valve, a dryer with a capillary tube, a vaporizer with plural ice-making rods and a liquid reservoir. The water tank has an ice-collecting box.

8 Claims, 9 Drawing Sheets

ICE-MAKING MACHINE

BACKGROUND OF THE INVENTION

1. Field of the Invention

This invention relates to an ice-making machine, particularly to one provided with a control faceplate on the surface of a machine body that has its interior formed with a water tank and an accommodating hollow. The water tank is bored with a water intake connected to the feed water pipe of the accommodating hollow by a water pipe. The accommodating hollow has its front side bored with a draining channel communicating with the water tank and one side bored with an insert hole and its outer wall provided with a trigger switch. Further, the accommodating hollow has its interior pivotally disposed with a water trough having its front side assembled with a push plate and its opposite sides respectively fixed with a pivot one of which is inserted through the insert hole of the accommodating hollow and fitted with the trigger switch. Furthermore, the machine body has its interior disposed with a freezing system composed of a compressor, a condenser, an electric magnetic valve, a dryer, a vaporizer and a liquid reservoir, which are connected together by pipes. The dryer has one end provided with a capillary tubes, and the vaporizer mounted on the water trough has its underside provided with a plurality of ice-making rods. An ice-collecting box is positioned on the support edge of the water tank. By so designing, sanitary ice blocks can be made quickly.

2. Description of the Prior Art

Ice blocks are widely used in most homes. They can be used for concocting drinks, freezing food or temporarily keeping food fresh, or even used for reducing a swelling or fever. A common method for making ice blocks in a home is to pour water into an ice-making box and then put the ice-making box into the freezing compartment of a refrigerator for making ice blocks.

However, apart from making ice blocks, a family refrigerator is employed for preserving food; therefore, in a process of making ice blocks, the water in the ice-making box may absorb various flavors of food in the refrigerator. In addition, it needs to take about an hour to make ice blocks in a conventional family refrigerator and the amount of the ice blocks made in the refrigerator is limited, unable to make ice blocks to meet urgent needs.

Additionally, if there is not any ice-making box for making ice blocks in a conventional family refrigerator, other kinds of containers have to be used instead, but the ice blocks made by these containers are different in size and difficult to be separated from the containers, resulting in much trouble in use.

SUMMARY OF THE INVENTION

The objective of the invention is to offer an ice-making machine able to quickly make ice blocks regular in size.

The ice-making machine of this invention includes a machine body having its surface provided with a control faceplate and its interior formed with a water tank and an accommodating hollow. The water tank is bored inside with a water intake having its rear end connected with a water pipe and a pump. The accommodating hollow has one end provided with a feed water pipe connected with the water pipe and its front side bored with a draining channel communicating with the water tank and further has one side bored with an insert hole and a notch. The machine body has its outer wall installed with a trigger switch at a location corresponding to the insert hole of the accommodating hollow. The water trough is pivotally assembled in the accommodating groove of the machine body, having its front side pivotally set with a push plate and its opposite sides respectively fixed with a pivot, with one pivot inserted through the insert hole of the accommodating groove and fitted with the trigger switch. A freezing system is installed in the interior of the machine body and composed of a compressor, a condenser, an electric magnetic valve, a dryer, a vaporizer and a liquid reservoir. The dryer has one end connected with a capillary tube, and the vaporizer positioned above the water trough has its underside provided with at least one ice-making rod. An ice-collecting box is supported on the support edge of the water tank.

BRIEF DESCRIPTION OF DRAWINGS

This invention will be better understood by referring to the accommodating drawings, wherein.

DETAILED DESCRIPTION OF THE PREFERRED EMBODIMENT

Figure 1:
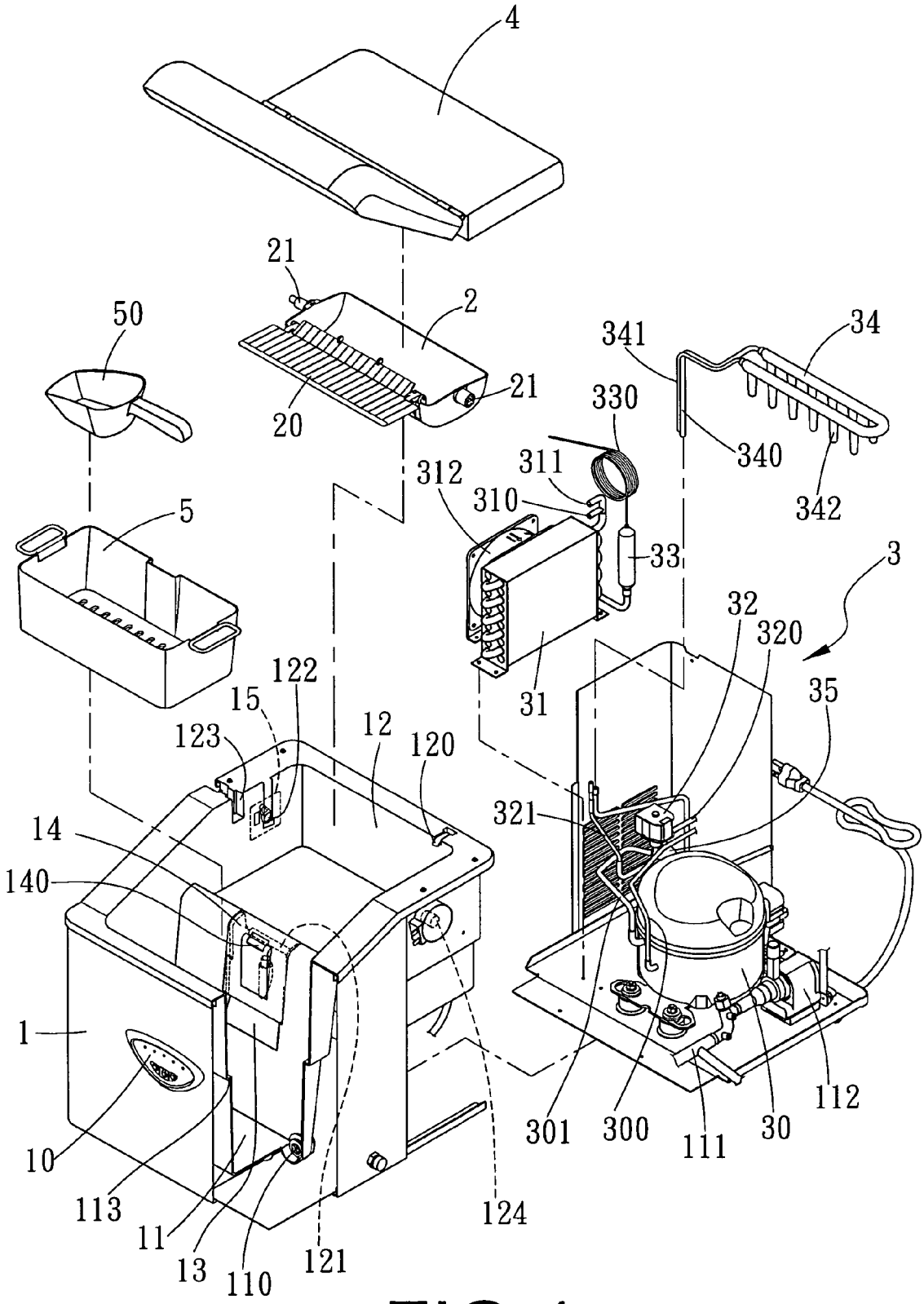
FIG. 1 is an exploded perspective view of an ice-making machine in the present invention.
Figure 2:
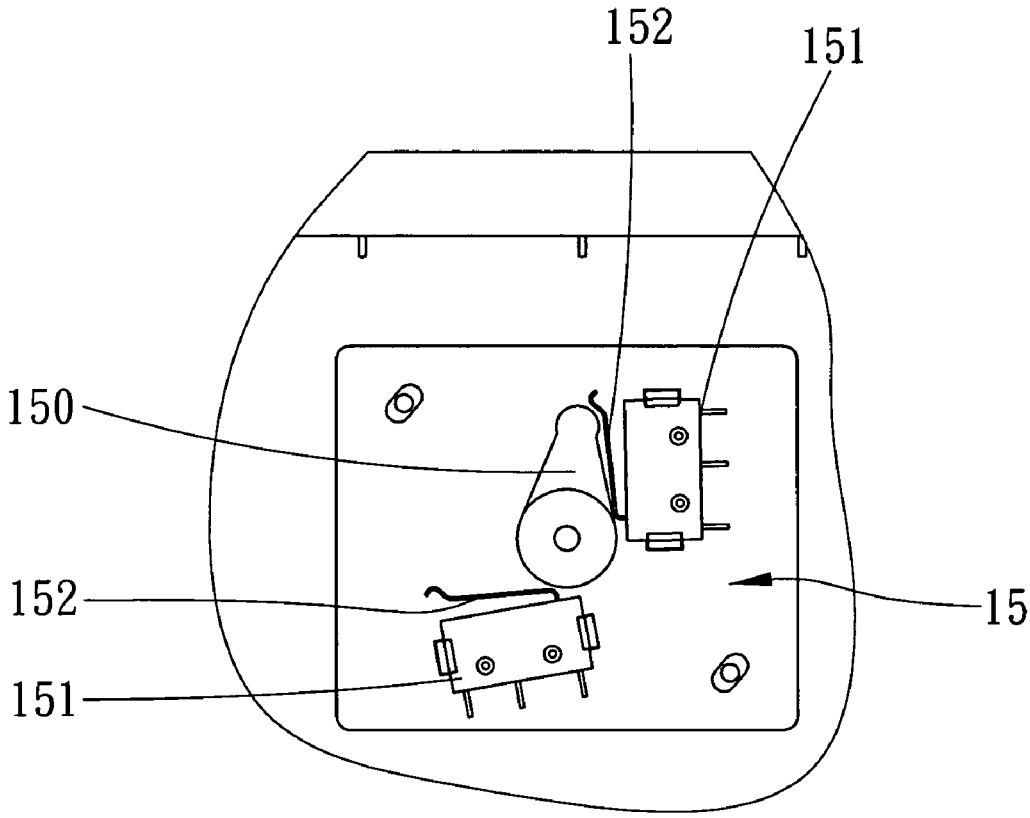
FIG. 2 is a cross-sectional view of a trigger switch in the present invention.
Figure 3:
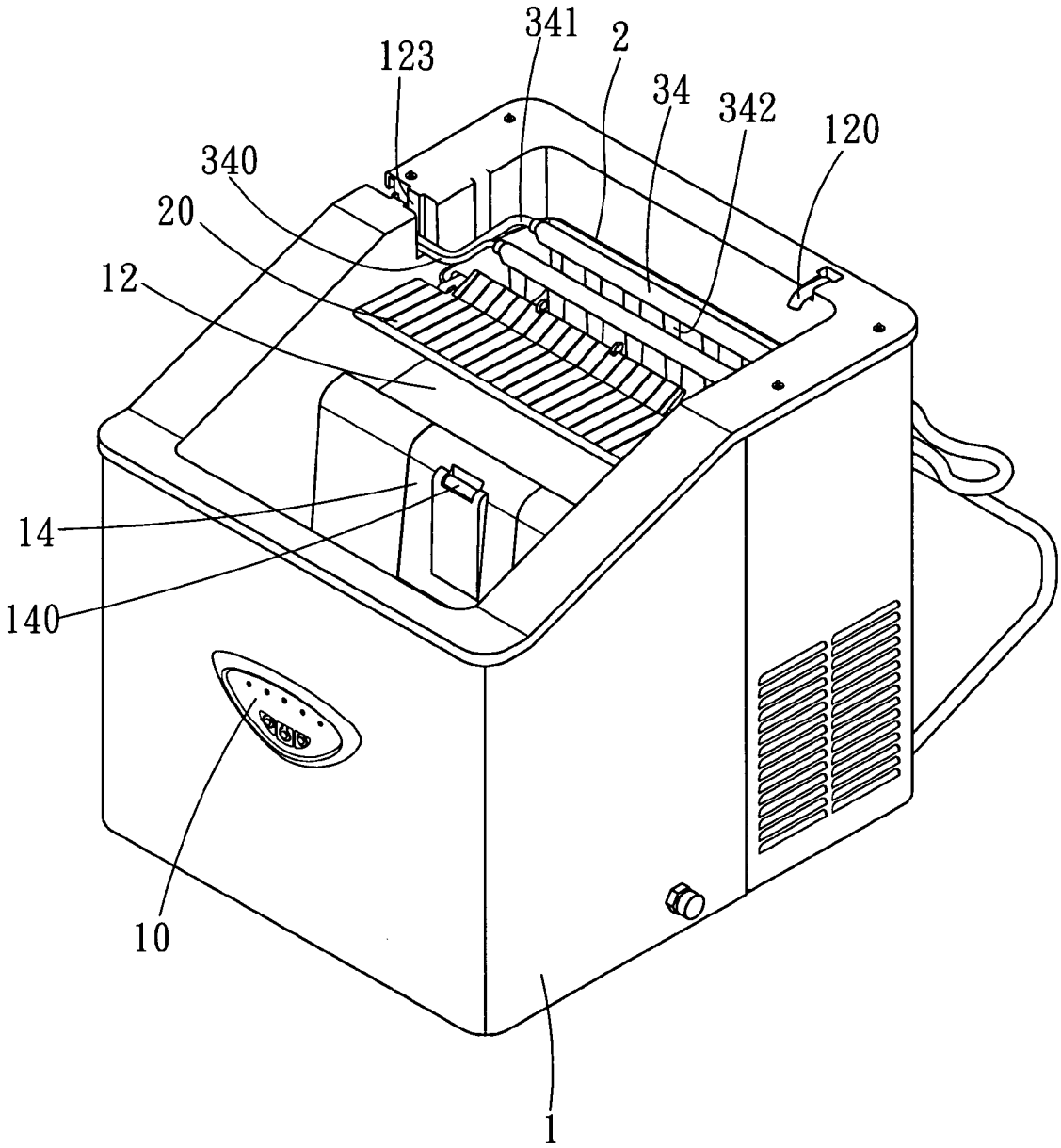
FIG. 3 is an upper cross-sectional view of the ice-making machine in the present invention.
Figure 4:
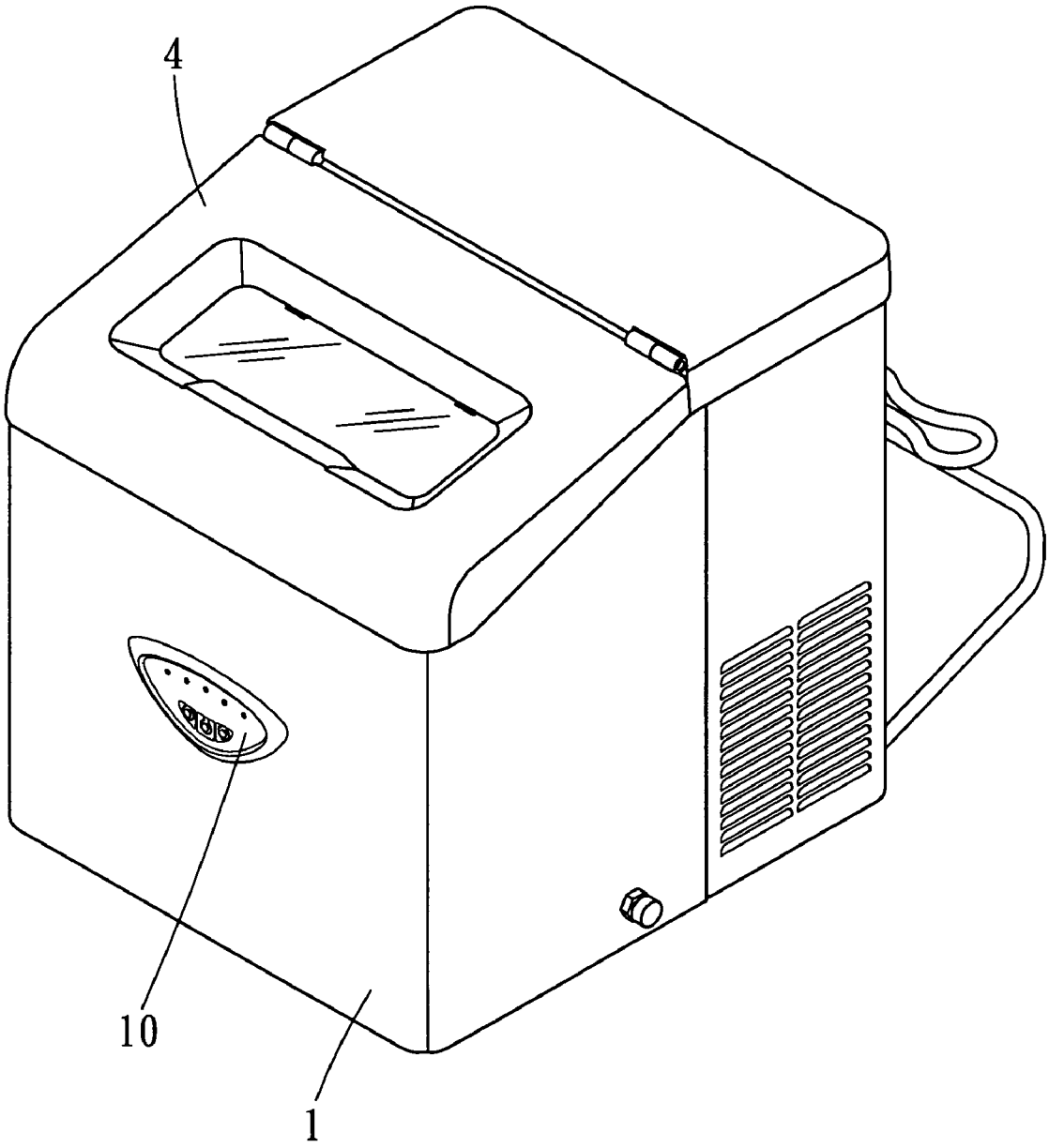
FIG. 4 is a perspective view of the ice-making machine in the present invention.
Figure 5:
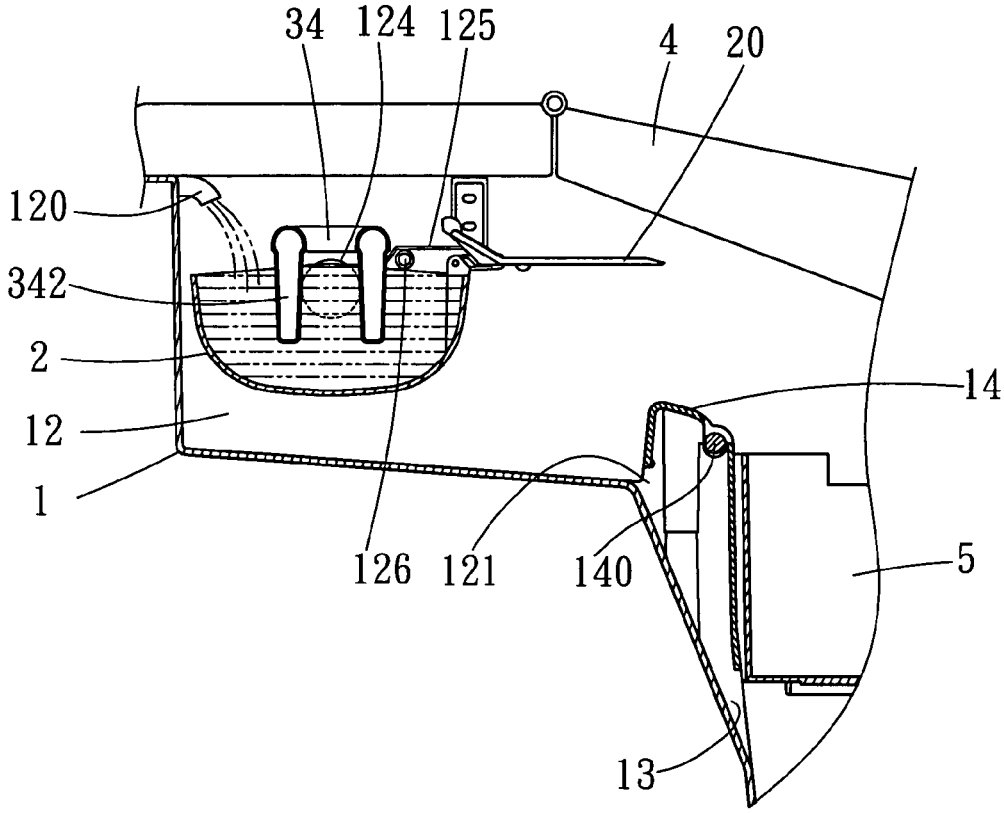
FIG. 5 is a cross-sectional view of a water trough and a part of an accommodating hollow in a water feeding condition in the present invention.
Figure 6:
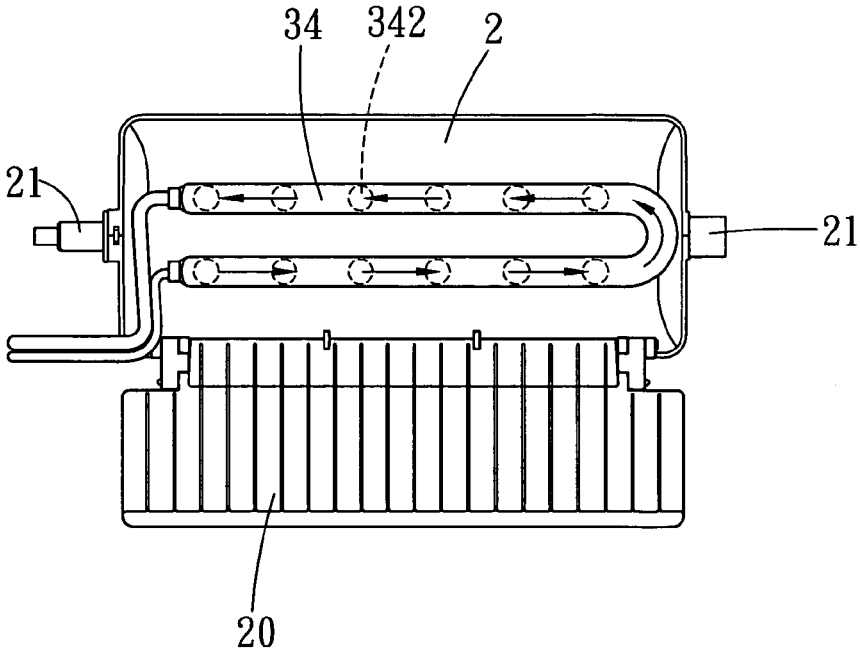
FIG. 6 is an upper view of a vaporizer and the water trough in the present invention.
Figure 7:
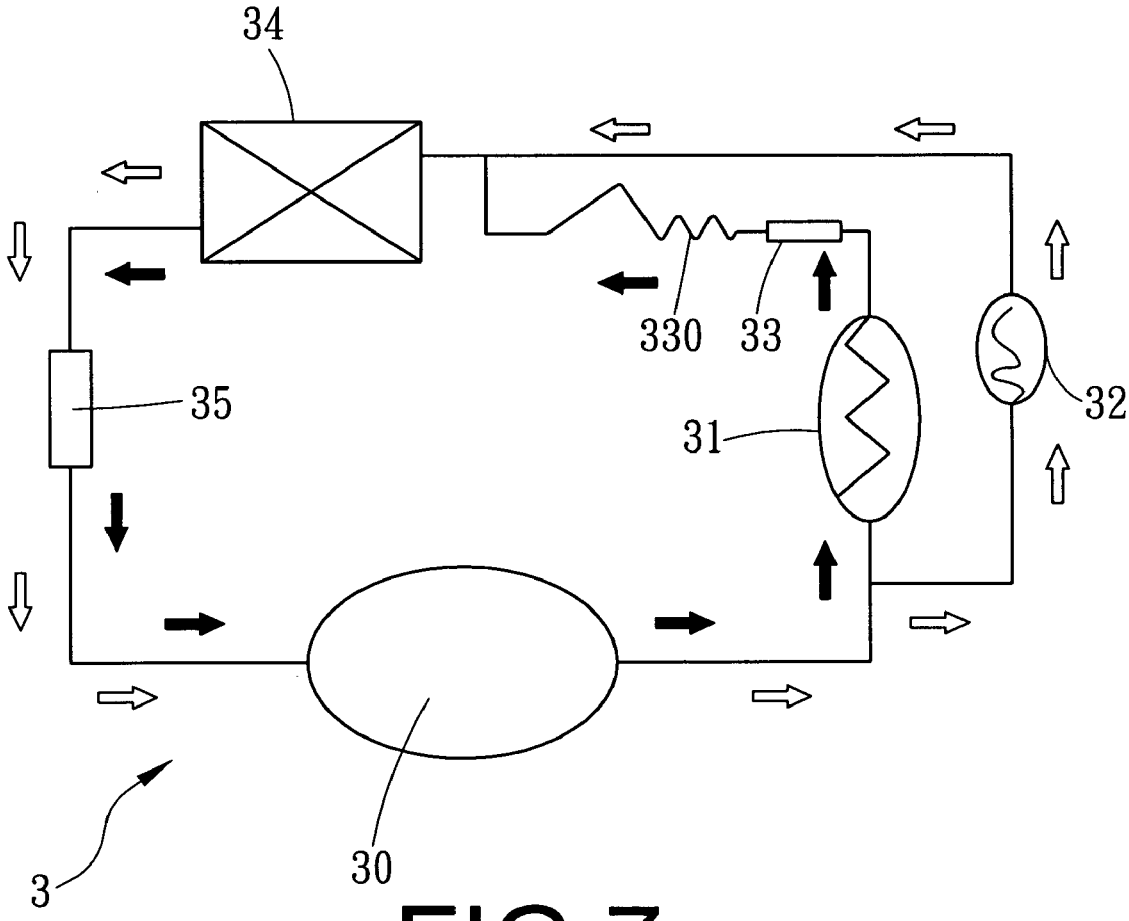
FIG. 7 is a flow chart of the operation of a freezing system in an ice making process in the present invention.
Figure 8:
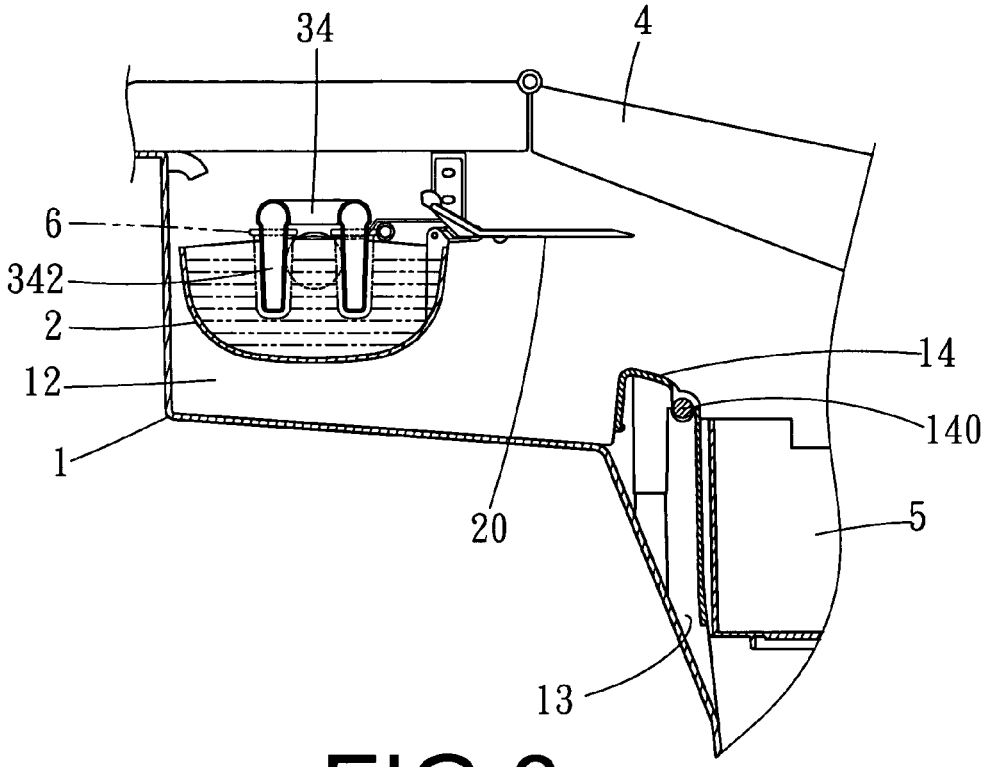
FIG. 8 is a cross-sectional view of a first step in an ice-making process in the present invention.
Figure 9:
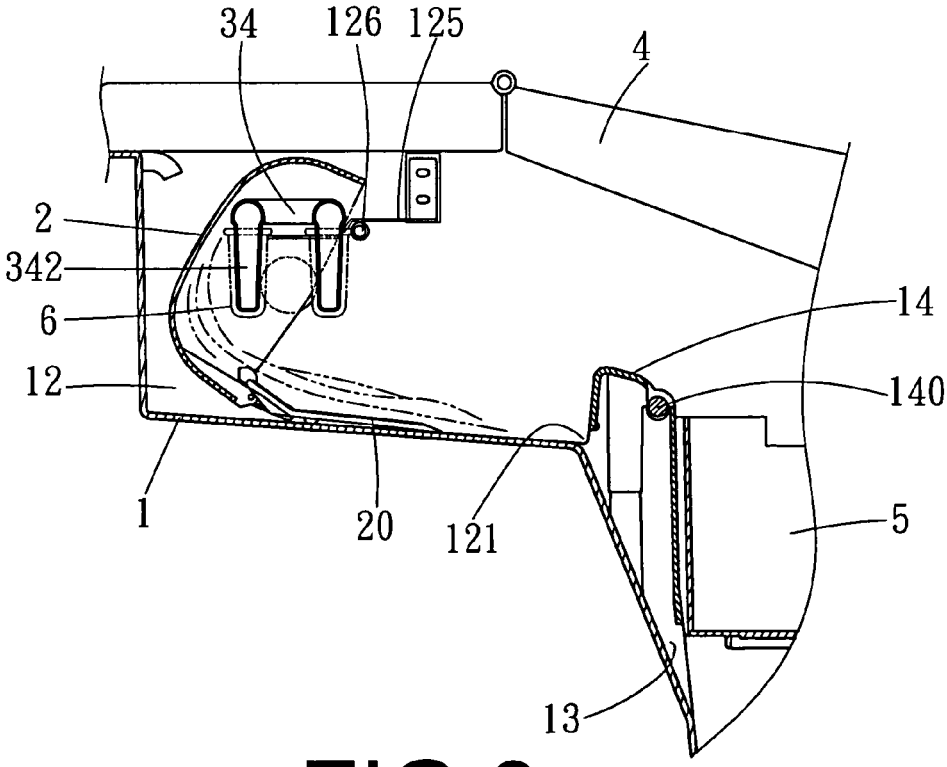
FIG. 9 is a cross-sectional view of a second step in an ice-making process in the present invention.
Figure 10:
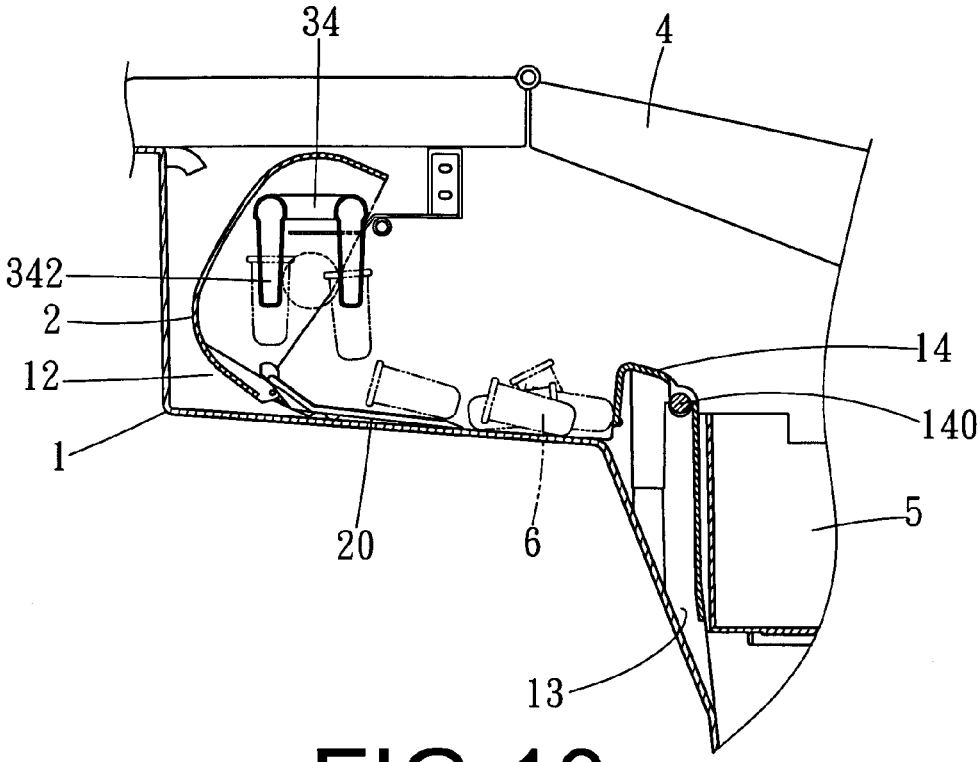
FIG. 10 is a cross-sectional view of a third step in an ice-making process in the present invention.
Figure 11:
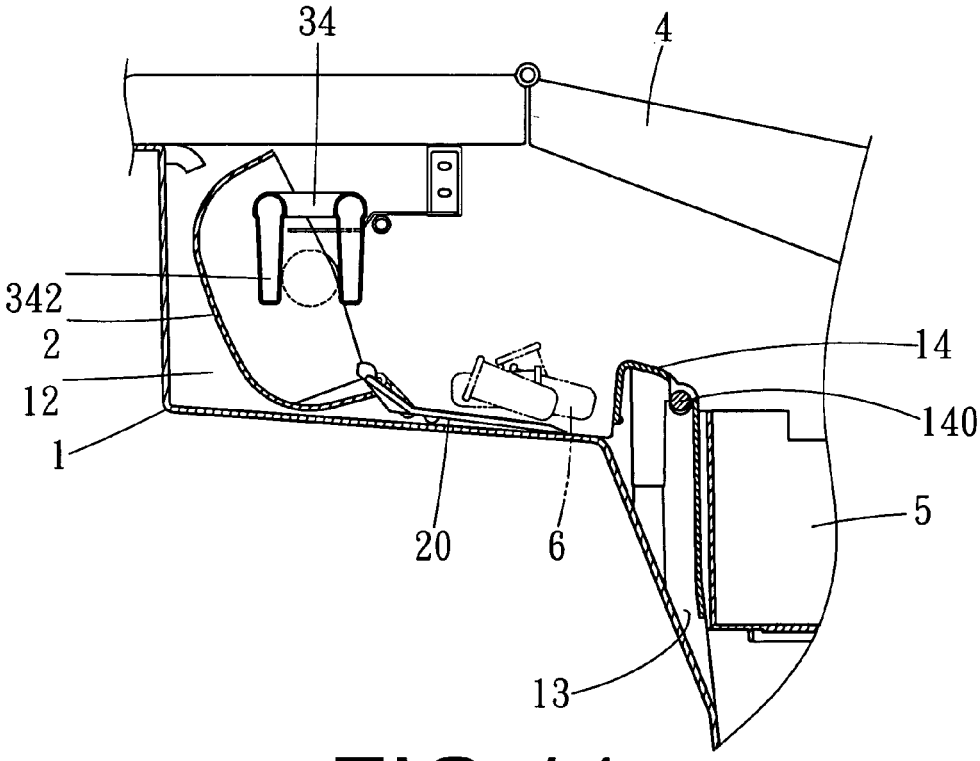
FIG. 11 is a cross-sectional view of a fourth step in an ice-making process in the present invention.

A preferred embodiment of an ice-making machine in the present invention, as shown in FIGS. 1-5, includes a machine body 1, a water trough 2, a freezing system 3, a filtering cover 4 and an ice box 5 combined together.

The machine boy 1 is provided with a control faceplate 10 on a front side and formed with a water tank 11 and an accommodating hollow 12 respectively in the front interior and in the rear upper interior. The water tank 11 has its bottom bored with a water intake 110 having its rear end connected with a water pipe 111 and a pump 112. Further, the water tank 11 is provided with a support edge 113 and the accommodating hollow 12 has one upper end provided with a feed water pipe 120 connected with the water pipe 111. A draining channel 13 is formed between the accommodating hollow 12 and the water tank 11 and has its upper side assembled with a cover 14 having a sensor 140 installed therein, with a draining port 121 formed between the cover 14 and the accommodating hollow 12. The accommodating hollow 12 is bored with an insert hole 122 and a slit 123 at one side and fixed with a water-trough positioning stud 124 at the other side opposite to the insert hole 122. A holding plate 125 and a stop block 126 are provided at the same side of the water-trough positioning stud 124. Further, the machine body 1 is installed with a trigger switch 15 on the outer wall of the accommodating hollow 12 at a location corresponding to the insert hole 122. The trigger switch 15 is provided with a trigger member 150 to be fitted with one pivot 21 of the water trough 2 and two trigger blocks 151 respectively positioned at a corresponding location of the opposite sides of the trigger member 150 and respectively having a trigger strip 152 fixed thereon.

The water trough 2 is pivotally assembled in the accommodating hollow 12 of the machine body 1, having a push plate 20 pivotally assembled at the front side. The water trough 2 further has its opposite sides respectively fixed with the pivot 21. The pivot 21 at one side of the water trough 2 is inserted through the insert hole 122 of the accommodating hollow 12 and fitted with the trigger switch 15, while the pivot 21 at the other side is pivotally assembled with the water-trough positioning stud 124.

The freezing system 3 installed in the interior of the machine body is composed of a compressor 30, a condenser 31, an electric magnetic valve 32, a dryer 33, a vaporizer 34 and a liquid reservoir 35. The compressor 30 positioned at the rear side of the machine body 1 is provided with a condenser connecting pipe 300 and a liquid-reservoir connecting pipe 301 respectively connecting the condenser 31 and the liquid reservoir 35. The condenser 31 is provided with a compressor adapter 310 and an electric magnetic valve adapter 311 to be respectively connected with the condenser connecting pipe 300 of the compressor 30 and the condenser connecting pipe 320 of the electric magnetic valve 32. Further, the condenser 31 has a fan 312 assembled at one side. The electric magnetic valve 32 is provided with a condenser-connecting pipe 320 and a vaporizer-connecting pipe 321 to be respectively connected with the condenser 31 and the vaporizer 34. The dryer 33 is connected with the end of the condenser 31 and has its upper end connected with a capillary tube 330 having its end linked with the vaporizer-connecting pipe and connected with the vaporizer 34. The vaporizer 34 is provided with a liquid-reservoir connecting pipe 340 and an electric magnetic connecting pipe 341 for respectively connecting the liquid reservoir 35 and the electric magnetic valve 32. Further, the vaporizer 34 combined with the holding plate 125 and positioned above the water trough 2 has its underside provided with a plurality of ice-making rods 342. The liquid reservoir 35 has one end connected with the vaporizer 34 and the other end connected with the liquid reservoir connecting pipe 301 of the compressor 30.

The lifting cover 4 is covered on the machine body 1.

The ice-collecting box 5 is positioned on the support edge 113 of the water tank 10 of the machine body 1 and provided with a separate ladle 50 for ladling out ice blocks 6 for use.

In operating, as shown in FIGS. 4~13, firstly, press a starting button through the control faceplate 10 of the machine body 1 to let water flow into the water pipe 111 through the water intake 110 of the water tank 11 and then pumped into the water trough 2 through the feed water pipe 120 by a pump 112. After the water trough 2 is filled up with water, the overflowing water of the water trough 2 will flow into the water tank 11 through the draining port 121 at the side of the accommodating hollow 12 and along the draining channel 13 to actuate the freezing system 3 to begin carrying out water freezing and ice making. In an ice making process, the compressor 30 of the freezing system 3 is started to have the refrigerant in the pipes pumped into the condenser 31. (The circulation direction of the refrigerant is shown by the black arrows in FIG. 7 and at this time the electric magnetic valve 32 is in a closed condition). Then, the refrigerant is conveyed into the vaporizer 34 through the dryer 33 and the capillary tube 330 and at this time, the refrigerant, due to the principle of volume expansion, evaporation and heat-absorption, will make the vaporizer 34 function to make ice. Since the ice-making rods 342 provided under the vaporizer 34 are extended into the water trough 2; therefore, water around the circumference of each ice-making rod 342 will quickly be frozen into ice block 6. After ice blocks 6 are frozen in shape, unfreezing work is to be carried out for separating the ice blocks 6 from the ice-making rods 342.

In unfreezing, as shown in FIGS. 6-13, firstly, start the trigger member 150 of the trigger switch 15 to rotate and actuate the water trough 2 to turn over upward to pour out of the water therein, and simultaneously the water will flow into the water tank 11 along the draining channel 13. When the trigger member 150 is rotated to touch and press the trigger strip 152 of the other trigger block 151, unfreezing and ice-separating work will be started. At this time, the electric magnetic valve 32 is turned off; therefore, the refrigerant sucked in the compressor 30 from the liquid reservoir 35 will circulate along two routes, that is, it will circulate along the original ice-making pipes and circulate to the vaporizer 34 through the electric magnetic valve 32, as shown by the black and the hollow arrows in FIG. 7. Since the refrigerant pumped out by the compressor 30 is of high temperature and high pressure and such refrigerant passing through the electric magnetic valve 35 is in large quantity; therefore, the heat energy of the refrigerant passing through the electric magnetic valve 35 is higher than that passing through the capillary tube 330, hence having function of unfreezing.

Figure 12:
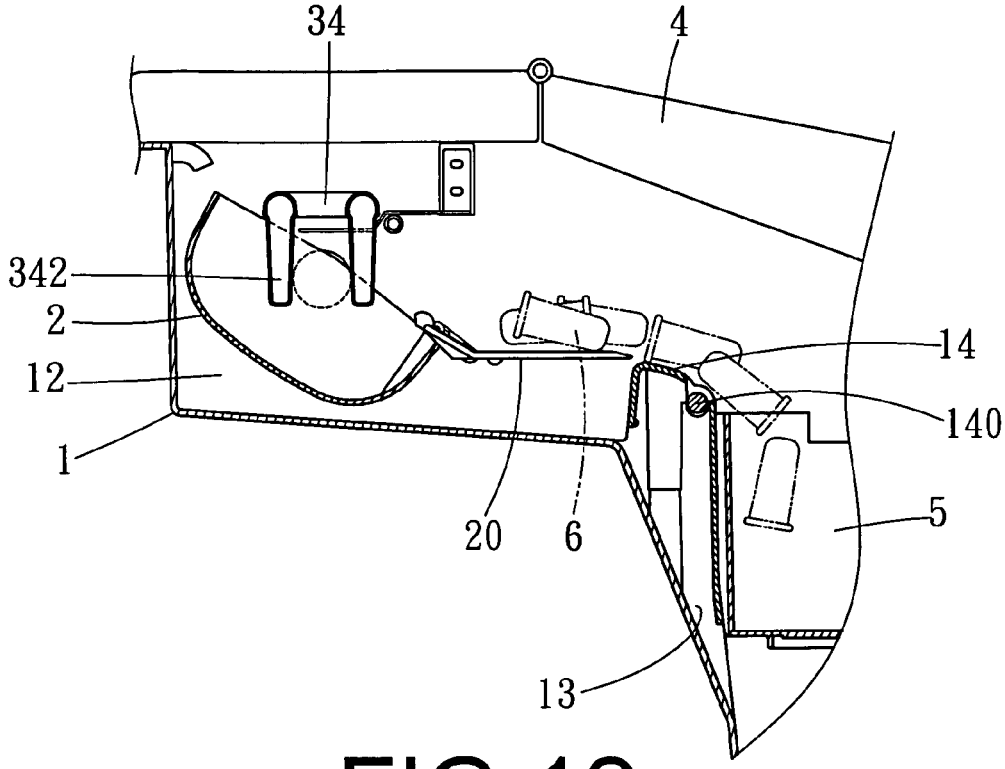
FIG. 12 is a cross-sectional view of a fifth step in an ice-making process in the present invention.
Figure 13:
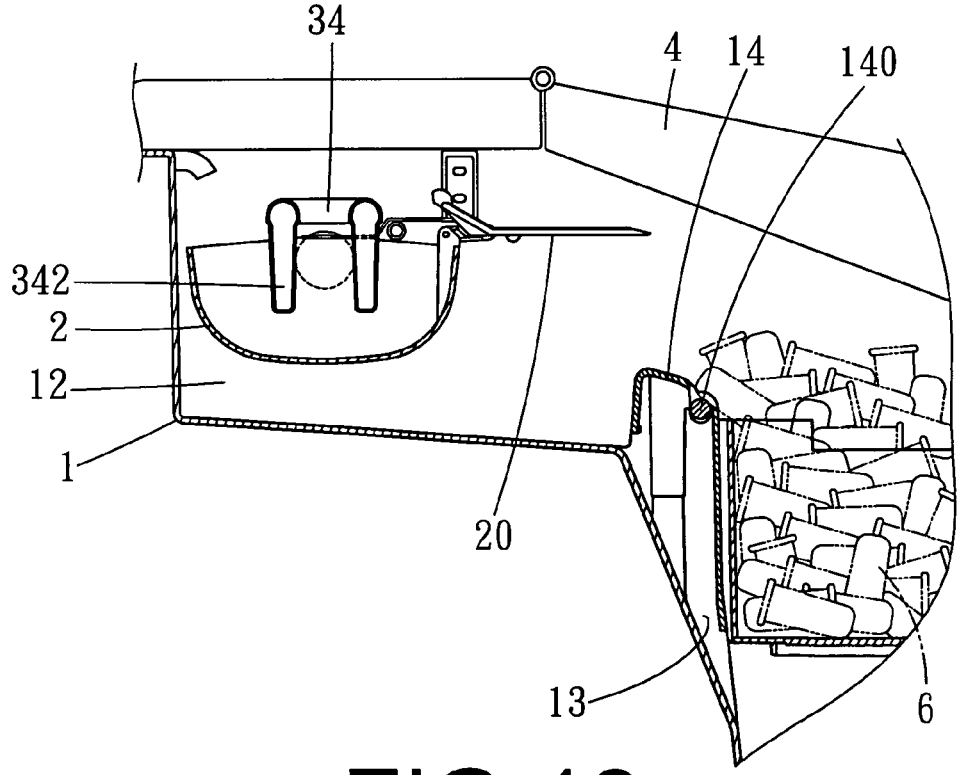
FIG. 13 is a cross-sectional view of a sixth step in an ice-making process in the present invention.

Thus, the ice blocks 6 can be separated from the ice-making rods 342 to drop into the accommodating hollow 12, and afterward the trigger member 150 will actuate the water trough 2 to turn back to its original position. In the meantime, the push plate 20 pivotally assembled at the front side of the water trough 2 will move together with the water trough 2 and shovel the ice blocks 6, which will then slide into the ice-collecting box 5 along the push plate 20, as shown in FIG. 12. When the ice-collecting box 5 is filled up with ice blocks 6, the superfluous ice blocks 6 of the ice-collecting box 5 will lean on the sensor 140, letting the sensor 140 sense the icy temperature and stop the ice-making machine from making ice blocks any longer, as shown in FIG. 13.

The ice-making machine of this invention can make ice in a short time (about ten minutes) and can carry out unfreezing conveniently for using the ice blocks immediately, and additionally ice blocks can be made according to the amount required.

In addition, the process of freezing and unfreezing can be controlled by turning on or off the electric magnetic valve 32, and the ice making and unfreezing work can be controlled by presetting time or temperature, and a temperature sensor could be provided on the vaporizer or on the water trough.

While the preferred embodiment of the invention has been described above, it will be recognized and understood that various modifications may be made therein and the appended claims are intended to cover all such modifications that may fall within the spirit and scope of the invention.

What is claimed is:

1. An ice-making machine comprising:

a machine body having its front side provided with a control faceplate, said machine body formed with a water tank and an accommodating hollow in the interior, said water tank bored with a water intake having its rear end connected with a water pipe and a pump, said accommodating hollow having one end provided with a feed water pipe connected with said water pipe, said accommodating hollow having its front side formed with a draining channel communicating with said water tank, said accommodating hollow further having one side bored with an insert hole and a slit, said machine body installed with a trigger switch on an outer side of said accommodating hollow at a location corresponding to said insert hole;

a water trough pivotally assembled in said accommodating hollow of said machine body, said water trough having its front side pivotally assembled with a push plate, said water trough having its opposite sides respectively fixed with a pivot, said pivot at one side inserted through said insert hole of said accommodating hollow and fitted with said trigger switch;

a freezing system installed in the interior of said machine body, said freezing system composed of a compressor, a condenser, an electric magnetic valve, a dryer, a vaporizer and a liquid reservoir, said dryer having one end connected with a capillary tube, said vaporizer having its underside provided with at least on ice-making rod, said vaporizer set above said water trough; and an ice-collecting box supported on the support edge of said water tank of said machine body.

2. The ice-making machine as claimed in claim 1, wherein said draining channel of said machine body has its upper side assembled with a cover, said cover provided with a sensor in its interior, a draining port formed between said cover and said accommodating groove.

3. The ice-making machine as claimed in claim 1, wherein said water tank of said machine box is provided with a support edge.

4. The ice-making machine as claimed in claim 1, wherein said accommodating hollow of said machine body is fixed with a water-trough positioning stud at the other side opposite to said insert hole, a fixing plate and a stop block disposed at the inner wall of the same side of said water-trough positioning stud.

5. The ice-making machine as claimed in claim 1, wherein said trigger switch provided with a trigger member fitted with said pivot of said water trough and two trigger blocks respectively disposed at a corresponding location of the opposite sides of said trigger member, said two trigger blocks respectively fixed thereon with a trigger strip.

6. The ice-making machine as claimed in claim 1, wherein said compressor of said freezing system is positioned at the rear side of said machine body, said compressor provided with a condenser connecting pipe and a liquid reservoir connecting pipe respectively connected with said condenser and said liquid reservoir, said condenser provided with a compressor adapter and an electric magnetic valve adapter respectively connected with said condenser connecting pipe of said compressor and said condenser connecting pipe of said electric magnetic valve, said condenser having one end provided with a fan, said electric magnetic valve provided with a condenser connecting pipe and a vaporizer connecting pipe respectively connected with said condenser and said vaporizer, said condenser having one end connected with a dryer, said dryer having one end connected with a capillary tube, said capillary tube having one end linked with said vaporizer connecting pipe of said electric magnetic valve to be connected with said vaporizer, said vaporizer provided with a liquid reservoir connecting pipe and an electric magnetic valve connecting pipe respectively connected with said liquid reservoir and said electric magnetic valve, said liquid reservoir having one end connected with said vaporizer and the other end connected with said liquid reservoir connecting pipe of said compressor.

7. The ice-making machine as claimed in claim 1, wherein a lifting cover is assembled on said machine body.

8. The ice-making machine as claimed in claim 1, wherein said ice-collecting box is provided with a separate ladle for ladling out ice blocks.

* * * * *